United States Patent [19]

Wallwork

[11] 4,231,414

[45] Nov. 4, 1980

[54] HANDLING FOUNDRY MATERIALS

[76] Inventor: Charles M. G. Wallwork, Church Cottage, Birtles La., Over Alderley, Cheshire, England

[21] Appl. No.: 909,470

[22] Filed: May 25, 1978

[30] Foreign Application Priority Data

May 27, 1977 [GB] United Kingdom ..... 22396/77

[51] Int. Cl.[3] ..... B22D 29/00

[52] U.S. Cl. ..... 164/154; 134/57 R; 164/401

[58] Field of Search ..... 164/4, 5, 131, 154, 164/401, 404, 414; 417/212; 60/445, 456; 118/663, 707; 134/57 R, 58 R

[56] References Cited

U.S. PATENT DOCUMENTS

| | | | |
|---|---|---|---|
| 2,129,944 | 9/1938 | Ladewig | 134/58 R X |
| 3,221,381 | 12/1965 | Nutter | 134/57 R X |
| 3,675,112 | 7/1972 | Smith | 60/445 X |
| 3,809,564 | 5/1974 | Feddern | 164/4 X |
| 3,958,623 | 5/1976 | Vissers | 164/154 X |
| 3,967,672 | 7/1976 | Wallwork | 164/181 |
| 4,108,188 | 8/1978 | McMullen et al. | 164/154 X |
| 4,169,498 | 10/1979 | Wilhelm | 164/414 X |

*Primary Examiner*—Robert D. Baldwin

*Attorney, Agent, or Firm*—Scrivener, Parker, Scrivener and Clarke

[57] ABSTRACT

In a rotatable shake-out drum designed to receive refractory moulds containing hot metal castings and to break them up, cooling water is fed to the drum in synchronization with the feeding of moulds to the drum so that the quantity of water fed into the drum varies with the rate of delivery of moulds into the drum.

5 Claims, 2 Drawing Figures

HANDLING FOUNDRY MATERIALS

Figure 1:
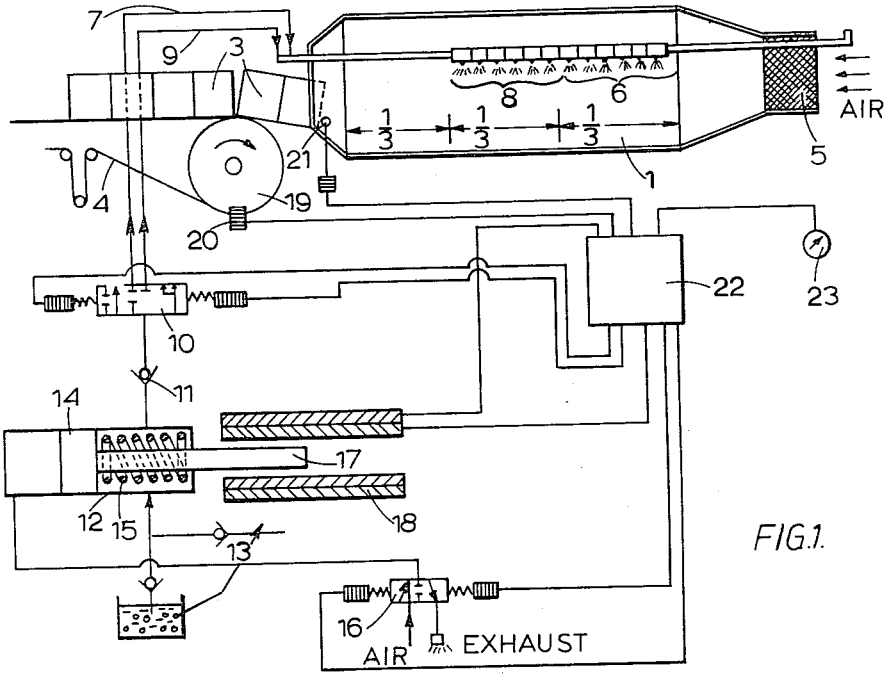

This invention relates to the cooling and shake-out of metal castings and the simultaneous treatment of the sand or similar refractory material (for convenience referred to below simply as sand) from the moulds in which the castings were made.

It is known, especially in automatic foundry moulding installations, to pass the moulds, with the castings still in them, to a rotating shake-out drum in which the moulds are broken up and the castings are extracted from them. The drum usually rotates about a horizontal or slightly inclined axis and at least part of its length is generally perforated to allow the sand to fall through onto a conveyor by means of which it is returned for re-cycling.

Both the castings and the sand are still very hot as they enter the drum. The sand by mixing intimately with the castings as they are both tumbled in the drum, acts to cool the castings. At the same time the heat from the castings tends to evaporate off any moisture present in the sand, and this may be assisted by passing a current of air through the drum.

Ideally the castings should leave the drum as cool as possible to facilitate their further handling, and the sand should also be cool but also of just the right moisture content to be re-cycled. It is known to add water to the sand so that the heat of evaporation of this moisture adds to the cooling effect. However it is difficult to adjust the quantity of water correctly to allow for varying sand-to-metal ratios and other factors and if too much moisture is added the sand will ball up and clog the holes in the perforated part of the drum; if there is too little the castings are not cooled sufficiently and furthermore the sand ends up too dry and requires further treatment before it can be re-cycled.

In any practical installation the heat input is varying all the time. For example, when starting up, the drum is initially cold. The rate of input of hot moulds may vary, and it may stop from time to time, for example while patterns are changed; not only the ratio of sand to metal may vary, but also the absolute size of mould.

Various proposals have been made for adjusting the flow of water in an endeavour to counteract these changes; for example it has been proposed to sense the temperature or the humidity of a sample of sand emerging from, or extracted from, the drum. Where the sand from moulds is cooled on a conveyor rather than in a drum it has been proposed to adjust the quantity of added water in response to means sensing the depth of sand on the conveyor. Another proposal has been to control the quantity of water added in accordance with the temperature of the air emerging from the drum.

The aim of the present invention is to provide an improved form of automatic control for the water added to the sand in a shake-out drum. According to the invention there is proposed a rotatable shake-out drum designed to receive refractory moulds containing hot castings and to break them up, and provided with means for adding an adjustable quantity of cooling water to the interior of the drum, in which the water is fed by delivery means synchronised with the feeding of the moulds to the drum. Thus in the simplest case it could be arranged that every time a mould is delivered to the drum, a quantity of water is delivered; therefore, when the rate of moulding is stepped up, the addition of water is increased correspondingly, and when moulding is interrupted so is the supply of water. It will be understood that the water deliveries could, within the scope of the invention, take place at a rate which is a simple fraction or a simple multiple of the rate of delivery of moulds.

The rate of delivery of moulds may be sensed by means detecting the actual moulds, or by means sensing movements of a conveyor that delivers the moulds to the drum (where the moulds are known to be close-packed) or by sensing operation of a machine that is making the moulds.

According to a further feature of the invention the quantity of water delivered at each delivery is itself variable in accordance with one or more other factors, such as drum temperature, mould size and metal-to-sand ratio. Some of these factors may be sensed continuously and automatically and used to control the delivery automatically; others may be fed in manually.

Preferably the delivery means comprise a simple reciprocating pump; its delivery can be varied by controlling valves but, more simply, by varying its stroke. The pump may be actuated by a pneumatic ram.

Figure 2:
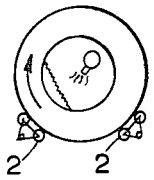

The invention will now be further described by way of example with reference to the accompanying drawings of which, FIG. 1 shows diagrammatically an installation for controlling the supply of water to a shakeout drum in the manner according to the invention, and FIG. 2 is a transverse section through the drum of FIG. 1.

The shake-out drum is shown at 1 and is shown as having its axis horizontal, although it could be slightly inclined, or indeed of adjustable inclination. It is mounted to rotate in supporting rollers 2, as indicated by the transverse section shown in FIG. 2. In the installation illustrated, the drum receives at its left-hand (input) end flaskless double-sided refractory sand moulds 3, arranged close-packed and with their mating faces vertical, carried on a conveyor 4 from an automatic moulding plant such as that disclosed in our British patent specification No. 803 332 or in our more recent British patent specifications Nos. 1 456 579 or 1 456 580. The moulds are advanced intermittently, and each time a newly produced mould is added to the far end of the line, the whole line of moulds is advanced by a distance equal to the thickness of one mould. The metal is poured at a fixed point into casting cavities at the interfaces between every adjacent pair of moulds.

As the moulds 3 containing the hot castings fall into the drum 1 they are carried along from left to right and broken up. The castings and the loose sand are thoroughly tumbled together so that heat is exchanged between them and eventually the sand falls through perforations 5 in the right-hand end of the drum whilst the castings emerge from that end and are carried away on a conveyor (not shown).

Means (not shown) are provided for passing a current of air through the drum 1 from outlet to inlet, as indicated by the arrows.

Looking at the main cylindrical part of the drum 1 as divided into equal thirds, an arry of non-drip water spray nozzles 6 occupies the third nearest the outlet end and is connected to a feed pipe 7. A similar array 8 occupies the central third and is connected to a separate feed pipe 9. These pipes are connected through a three-position solenoid-operated valve 10 and a check-valve 11 to a water-delivery pump cylinder 12 fed from a water supply 13.

The pump cylinder 12 has a piston 14 which is urged to left by a return spring 15 and is moved to the right, to deliver water to the spray nozzles, by the admission of compressed air to the left-hand end of the cylinder under the control of a two-position solenoid valve 16 that admits air in one position and connects the cylinder to exhaust in its other position.

A rod 17 connected to the piston 14 projects through a seal in the right-hand end of the cylinder and forms the armature of an electromagnetic sensing device 18 for sensing the position of the piston 14 within the cylinder. This sensing device comprises primary and secondary solenoid-shaped coils enclosing the path of the rod 17, the coils being coupled together to a greater or lesser extent according to the position of the rod.

Where the conveyor 4 passes over a drum 19 its movement is detected by a sensing device 20, which may be electromagnetic. The distance through which the conveyor moves at each cycle and hence the angular distance through which the drum turns is dependent upon the thickness of the moulds. As the moulds are of constant width and height, this distance therefore gives a measure of the quantity of sand delivered to the drum at each cycle.

A thermally responsive device 21 senses the mean temperature of the sand and castings at the inlet end of the shake-out drum.

The various signals from the sensing devices 18, 20 and 21 are fed to a control box 22 together with a signal from a manual control device 23 which can be set by the operator of the machine according to the known ratio of metal to sand in the particular run of moulds being produced at any given time. As the ratio of metal to sand is linked to patterns being used, it will be appreciated that it is possible without difficulty to arrange that each set of pattern plates used in the moulding machine can carry some kind of coded information that sets an automatic control in place of the manual device 23. This is of value particularly where the machine incorporates arrangements for automatic pattern-changing.

In normal operation of the installation, the control box 22 energises the valve 16 to admit air to the cylinder 12 and pump water to the nozzles 6 and/or 8 every time a mould enters the drum 1, as detected by the device 20. As the pump piston 14 moves the rod 17 enters the device 18 and when a certain position has been reached, the control box 22 acts on the valve 16 to connect the cylinder to exhaust, allowing the spring 15 to return the piston to its starting position, drawing in more water from the supply. The position of the piston at which this happens is influenced by the signals from all three devices 20, 21 and 23. Thus the amount of water delivered at each stroke of the piston 15 (i.e. on delivery of each mould to the drum) is controlled in accordance with (a) the thickness of the mould (and therefore the weight of sand), (b) the temperature of the sand/metal mix at the inlet of the drum, and (c) the ratio of metal to sand.

In this way it is possible to control the quantity of water more effectively than hitherto possible, and to ensure that the heat input from the castings is balanced by the heat removed by evaporation so that the sand emerging from the drum is of consistent quality despite variations in the factors mentioned.

On starting up, with the drum 1 cold, initially no water will be added, the movement of the piston 14 being inhibited by the low value, or absence, of signal from the temperature-sensing device 21.

Alternatively, even if the piston 14 moves, delivery to the nozzles may be inhibited by the valve 10 being in its cut-off position, and the water is simply delivered to waste.

For the run which is to start, the operator will already have set the device 23 to the appropriate value for the patterns being used. At first the moulds coming into the drum will be cold, if they have been standing overnight. Then, as hot moulds start reaching the drum and the temperature rises, the cylinder 12 starts operating, initially with a short stroke that becomes progressively longer. At first the valve 10 is in a position that allows delivery only to the pipe 9 and nozzles 8 in the central part of the drum 1. Then as the temperature rises further and the pump stroke increases, the valve 10 is moved to a position allowing delivery to both sets of nozzles 6 and 8.

I claim:

1. In a foundry moulding installation including a rotatable shake-out drum adapted to receive refractory moulds containing hot metal castings and to break them up, means for feeding moulds intermittently to the drum, and means for delivering cooling water to the interior of the drum, the improvement wherein said water delivery means comprises a reciprocating variable stroke pump, and means responsive to the operation of said intermittent feeding means for starting and stopping said pump in synchronism with the starting and stopping of said feeding means whereby said pump is capable of delivering cooling water to said drum only upon the feeding of moulds into said drum.

2. A rotatable shake-out drum as in claim 1 including means for varying the stroke of said pump in accordance with a factor dependent on the temperature at the end of the drum into which moulds are delivered.

3. In the installation of claim 1 including, in addition, means for varying the stroke of the pump in accordance with the ratio of metal to refractory material in each mould.

4. In the installation of claim 1 wherein said means for delivering water into said drum includes at least two separate groups of delivery nozzles located at different axial positions along the length of the drum, and control means are provided for supplying water selectively from the pump to one or more of said sets of nozzles.

5. In the installation of claim 1 including a control box, sensing devices for monitoring factors concerned with the heat input to the drum and including a sensing device for sensing operation of said feeding means and a sensing device for sensing the temperature in said drum, and supplying signals to said control box in accordance with the factors sensed, a manually operated control device adapted to be set by an operator in accordance with the known ratio of metal to refractory material in a particular run of moulds and supply a further signal to said control box in accordance with the setting of said device, said control box being constructed and arranged to supply an output signal to said pump for controlling the actuation of said pump in accordance with the several input signals supplied to said control box.

* * * * *